United States Patent [19]

Hidaka

[11] Patent Number: 4,671,505

[45] Date of Patent: Jun. 9, 1987

[54] SORTING APPARATUS

[75] Inventor: Masanori Hidaka, Mito, Japan

[73] Assignee: Ikegami Tsushinki Co., Ltd., Tokyo, Japan

[21] Appl. No.: 772,762

[22] Filed: Sep. 5, 1985

[30] Foreign Application Priority Data

Sep. 11, 1984 [JP] Japan ..... 59-188913

[51] Int. Cl.[4] ..... B65H 39/10

[52] U.S. Cl. ..... 271/293; 271/200; 271/294

[58] Field of Search ..... 271/294, 292, 293, 200

[56] References Cited

U.S. PATENT DOCUMENTS 4,478,406 10/1984 DuBois ..... 271/296 X

FOREIGN PATENT DOCUMENTS 74856 4/1984 Japan ..... 271/293

215895 12/1984 Japan .

*Primary Examiner*—Richard A. Schacher

*Attorney, Agent, or Firm*—Fliesler, Dubb, Meyer & Lovejoy

[57] ABSTRACT

A sorting apparatus includes a plurality of trays, each having a pair of tray pins on the both sides of the sheet inlet of the tray and being held in a stacked condition; tray inlet holding members interposed between the tray pins of the vertically adjacent trays to define an inlet for a sheet and being vertically movable and rotatable; member which, upon rotation of the tray inlet holding member, moves the tray pins which are in contact with the holding members vertically while the holding member moves in the opposite vertical dirction, thereby shifting the sheet inlet defined between the tray pins; and supporting members disposed not to interfere with the vertical movement of the holding member and made into contact with the respective pairs of the tray pins in such a manner that the supporting members bear the bearing load produced from each tray and permit the tray pins to override the supporting members when the bearing load is greater than a predetermined value. Since the supporting member does not bear the whole weight of the stacked trays, a great driving force is not required to rotate the supporting member, and the capacity of the motor for driving the supporting member can be decreased.

8 Claims, 11 Drawing Figures

SORTING APPARATUS

BACKGROUND OF THE INVENTION

1. Field of the Invention

The present invention relates to a sorting apparatus and more particularly to a sorting apparatus which is used to automatically sort recorded sheets.

2. Description of the Prior Art

In a prior art sorting apparatus of the type described above, a plurality of trays in which printed and then sorted sheets are stored are disposed vertically along a sheet discharge unit fixed relative to the trays. In like manner, a sheet feeding unit which receives sheets from a host system such as a copying machine is also fixed. The sheets which are received from a sheet discharge portion of the host system are transported by a transport member to the sheet discharge unit from which the sheets are directed to the respective trays.

That is, in the sorting apparatus of the type described, in order to align the inlet of the tray into which the sheets are introduced with the fixed discharge unit whenever the sheets are fed, a plurality of trays must be sequentially moved vertically. To this end, in response to the sheet feeding operation, a plurality of trays must be, for example, moved or shifted downward or upward by one stage by a moving or shifting member.

However, when the sheet feeding unit, the sheet discharge unit and the transport passage interposed therebetween are fixed, it is necessary to provide a sufficient space which can accommodate a predetermined number of trays both above and below the sheet discharge unit, so that a plurality of trays can be moved both upward and downward. As a result, the whole height of the sorting apparatus is increased, resulting in that the sorting apparatus is large in size.

Furthermore, the position of the sheet feeding unit which receives the sheets from the host system is not variable, so that one sorting apparatus cannot be used in common to various types of host systems. In addition, in the prior art sorting apparatus in which the trays are permanently or semipermanently fixed, it is required that the sheet transport member and the sheet sorting member must be co-operative with each other so that a sheet is transported into a desired tray from the sheet feeding unit. This causes that the sorting apparatus becomes very complicated in mechanism.

In order to overcome the above and other problems encountered in the prior art sorting apparatus, there has been proposed a sorting apparatus of the type disclosed in Japanese Laid-open Patent Application Publication No. 59-215895, laid-open on Dec. 5, 1984. In this apparatus, a horizontal shaft carries at its both ends cams (Geneva wheels), each of which is in the form of a disc and has slots along the periphery. The horizontal shafts has its ends fitted into vertical guide grooves in such a way that the horizontal shaft is vertically slidable. The upper and lower peripheral surfaces of the Geneva wheel support tray pins extended from both ends of the tray, whereby a tray inlet is defined between them. Upon rotation of the horizontal shaft and the Geneva wheels, the tray pins are fitted into the slots so that the tray itself is moved upward or downward and consequently the tray inlet is defined at a shifted position.

FIGS. 1 and 2 show the sorting apparatus of the type described above. Reference numeral 1 designates a Geneva wheel in the form of a disc cam which is attached to a rotating shaft 2 at its substantially end position. The Geneva wheel 1 has slot 1A into which a tray pin 3A is slidably fitted. The rotating shaft 2 is supported through bushings 24 by opposed frame walls 4 in such a manner that the rotating shaft 2 can be vertically moved along guide grooves 5 formed in the frame walls 4.

As shown in FIG. 2, the rotating shaft 2 has a sprocket wheel 6 and is driven in a direction selected by a reversible motor 8 through a belt 7 drivingly intercoupling the motor 8 to the sprocket wheel 6. A hollow rotating shaft 9 into which the rotating shaft 2 is inserted is loosely and coaxially engaged with the rotating shaft 2 and is driven by a motor 10 through a belt 11. Upon rotation of the hollow rotating shaft 9, a sheet is discharged from a tray inlet 17 to a tray 13A disposed below the tray inlet 17 by sheet discharge rollers 12 carried by the hollow rotating shaft 9. Reference numeral 14 denotes a groove into which the tray pins 3A are vertically slidably fitted. Reference numeral 15 is a transport member which is a part of a recording apparatus such as a copying machine. The stacked trays 13 are supported by a tray stand 25.

In the sorting apparatus of the above-described construction, when the tray inlet holding member, that is, the Geneva wheel 1 is rotated, for instance, in the clockwise direction from the position as shown in FIG. 1, then the tray 13 which has been supported by the upper half of the periphery of the Geneva wheel 1 drops into the slot 1A, so that this tray 13 can be lowered by the tray pin 3A to the position where the tray 13 is stacked on the second tray 13 immediately below the first mentioned tray 13, whereby the tray inlet 17 is defined upward by one stage.

When the Geneva wheel 1 is rotated in the counterclockwise direction from the position as shown in FIG. 1, the pin 3A which has been in contact with the lower half of the outer periphery of the Geneva wheel 1 engages with the slot 1A, so that the tray 13 is lifted to the position where the first mentioned tray 13 lifts the second tray 13 immediately above the first mentioned tray 13.

In this manner, as shown in FIG. 3, the lower trays 13 are sequentially moved upward, while the Geneva wheel 1 is lowered accordingly, so that sheet guide members 11A and 11B are inclined downwardly and consequently the sheet 23 is directed into the tray inlet 17 by a discharge roller 12 as shown in FIG. 3.

However, when it is desired to move a desired tray 13 in the sorting apparatus of the type described above, there arises the problem that, as shown in FIG. 3, the Geneva wheel 1 must bear the whole weight of the trays positioned above the Geneva wheel 1.

That is, while the stacked trays 13 are supported by the tray stand 25, the leading ends of the stacked trays 13 are supported through a support (not shown) in such a way that the leading ends are made into contact with each other. On the other hand, on the side of the tray inlet 17, the Geneva wheel 1 serves as cantilever and supports the whole weight of the trays disposed above the Geneva wheel 1.

The load applied to the Geneva wheel 1 is increased as the Geneva wheel 1 is positioned lower; that is, when the inlet 17 is defined between the lower trays. Especially, when many recorded and sorted sheets are stacked on each of the trays 13, a heavier load is exerted to the Geneva wheel 1.

When the motor 8 must drives to rotate the Geneva wheel 1 so that the pin 3A which has been in contact with the lower half of the periphery of the Geneva wheel 1 is caused to engage with the slot 1A, thereby moving it upward the work is required for driving the Geneva wheel 1 against the load of the stacked trays, in addition to the work done for moving one tray 13 itself upward in the manner described above. As a result, the torque of the motor 8 must be increased. That is, a power supply, the motor 8 and other mechanisms are so designed and constructed to produce such a great torque.

Recently, it is desired that the sheets are processed at a high speed and that many sheets are stored in one sorting apparatus. As a result, the cost is increased. In addition, whenever a new type of sorting apparatus is designed, the capacity of the motor 8 and the mechanism associated with the motor 8 must be determined based upon the above described conditions. This results in the increase of design cost.

SUMMARY OF THE INVENTION

The present invention was made in order to substantially overcome the above and other problems encountered in the prior art sorting apparatus and has for its object to provide a sorting apparatus in which when a tray inlet is modified by tray inlet holding member, the tray inlet holding member is free from the influence of the weight of the trays which are supported by and stacked on the tray inlet holding member, so that the capacity of the motor for driving the inlet holding member can be reduced.

To the above and other ends, according to the present invention, a pair of supporting members which maintain contact with respective tray pins and which can bear the weight of each of the trays are disposed at the positions where the supporting members will not interfere the movement of the tray inlet holding members.

A sorting apparatus according to the present invention comprises:

a plurality of trays, each having a pair of tray pins on the both sides of the sheet inlet of the tray and being held in a condition that the trays are stacked;

tray inlet holding members interposed between the tray pins of the vertically adjacent trays in a manner that the tray inlet holding members defined an inlet for a sheet, the tray inlet holding member being vertically movable and rotatable;

member which, upon rotation of the tray inlet holding member, moves the tray pins which are in contact with the tray inlet holding members vertically while the tray inlet holding member moves in the opposite vertical direction, thereby shifting the sheet inlet defined between the tray pins; and supporting members which are so disposed that the supporting members do not interfere with the vertical movement of the inlet holding member and that the supporting members are made into contact with the respective pairs of the tray pins in such a manner that the supporting members bear the bearing load produced from each tray and permit the tray pins to override the supporting members when the bearing load is greater than a predetermined value.

Here, the tray inlet holding members can be a pair of cylinders, each of which has a spiral groove formed on the cylindrical surface thereof and which are vertically slidably supported by a pair of rotating shafts arranged vertically in parallel, respectively, in a manner that the cylinders are rotated by the pair of rotating shafts, respectively.

Each of the tray inlet holding members may have a disc cam which is rotatable horizontally and which has a slot which is formed in the outer peripheral surface thereof and with which the tray pin is engageable.

The above and other objects, effects, features and advantages of the present invention will become more apparent from the following description of preferred embodiments thereof taken in conjunction with the accompanying drawings.

DETAILED DESCRIPTION OF PREFERRED EMBODIMENTS

FIGS. 4–7 show an embodiment of a sorting apparatus in accordance with the present invention. In this sorting apparatus, cylinders are vertically slidably fitted over a pair of parallel rotating shafts, respectively, so that they define sequentially a tray inlet between the adjacent trays of a plurality of trays. A sheet discharge member is movable in unison with the cylindrical tray inlet holding members so that a feeding member for feeding sheets to the discharge member is displaced in response to the movement of the discharge member.

Figure 4:
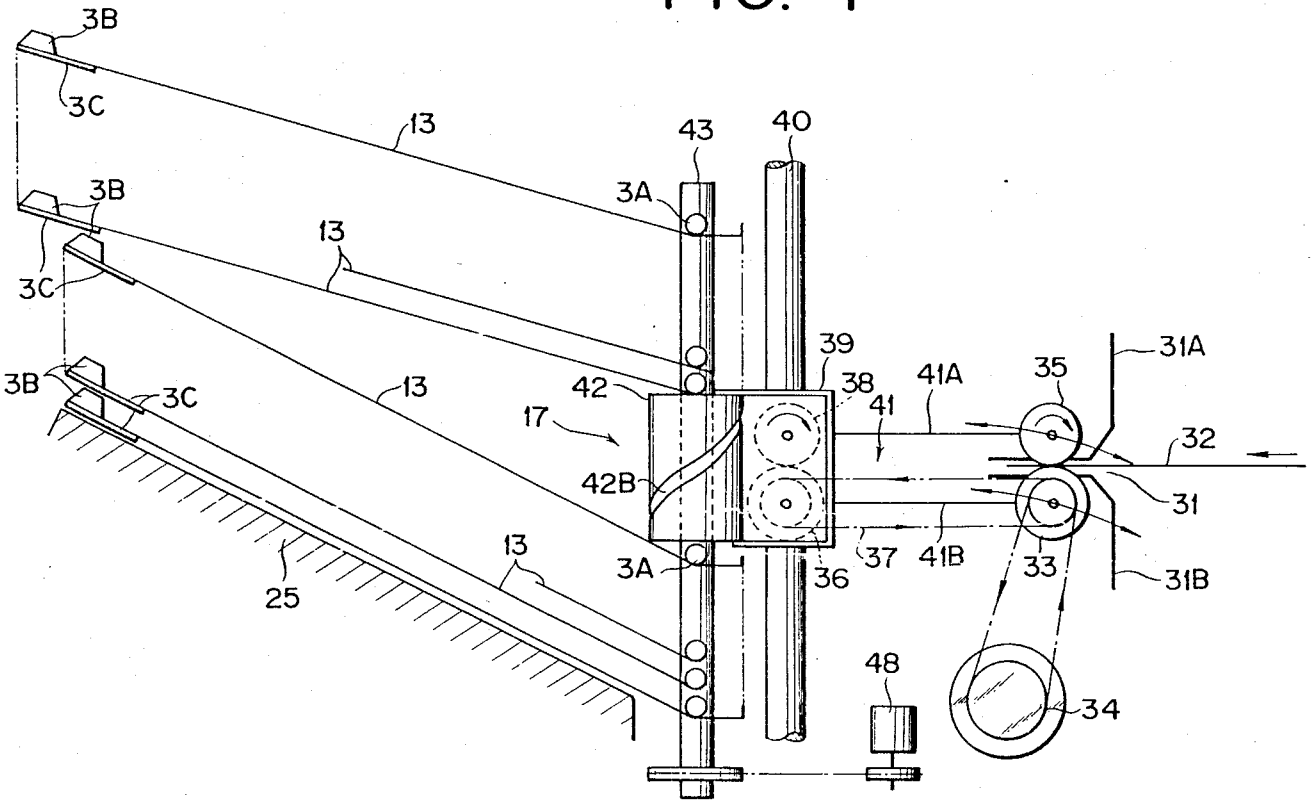
FIG. 4 is a side view showing an embodiment of a sorting apparatus in accordance with the present invention.

Referring first to FIG. 4, reference numeral 31 designates a sheet feeding unit having an upper guide plate 31A and a lower guide plate 31B. A printed or copied sheet 32 which is discharged from a printer or a copying machine (not shown) is fed between the upper and lower guide plates 31A and 31B.

Reference numeral 33 designates a feed roller which is driven by a motor 34; 35, a guide roller in contact with the feed roller 33 for feeding the printed sheet 32; 36, a discharge roller 36 which is drivingly coupled to the feed roller 33 through an endless belt 37; and 38, a guide roller in contact with the discharge roller 36 for discharging the printed sheet 32. The discharge roller 36 and the guide roller 38 are supported by a frame 39 which in turn is slidable along a guide rod 40. Reference numerals 41A and 41B designate an upper guide plate and a lower guide plate, respectively, which are extended between the guide rollers 35 and 38 and between the feed roller 33 and the discharge roller 36. The upper and lower guide plates 41A and 41B defines a sheet feeding passage 41.

Reference numeral 42 designates a cylindrical tray inlet holding member which has the rotating shaft 43. The upper and lower members of the frame 39 slidably support the upper and lower surface of the tray inlet holding member 42, respectively, so that, as will be described in detail below, when the tray inlet holding member 42 is moved vertically, the discharge roller 36 and the guide roller 38 are simultaneously moved also vertically in unison with the frame 39.

Figure 5:
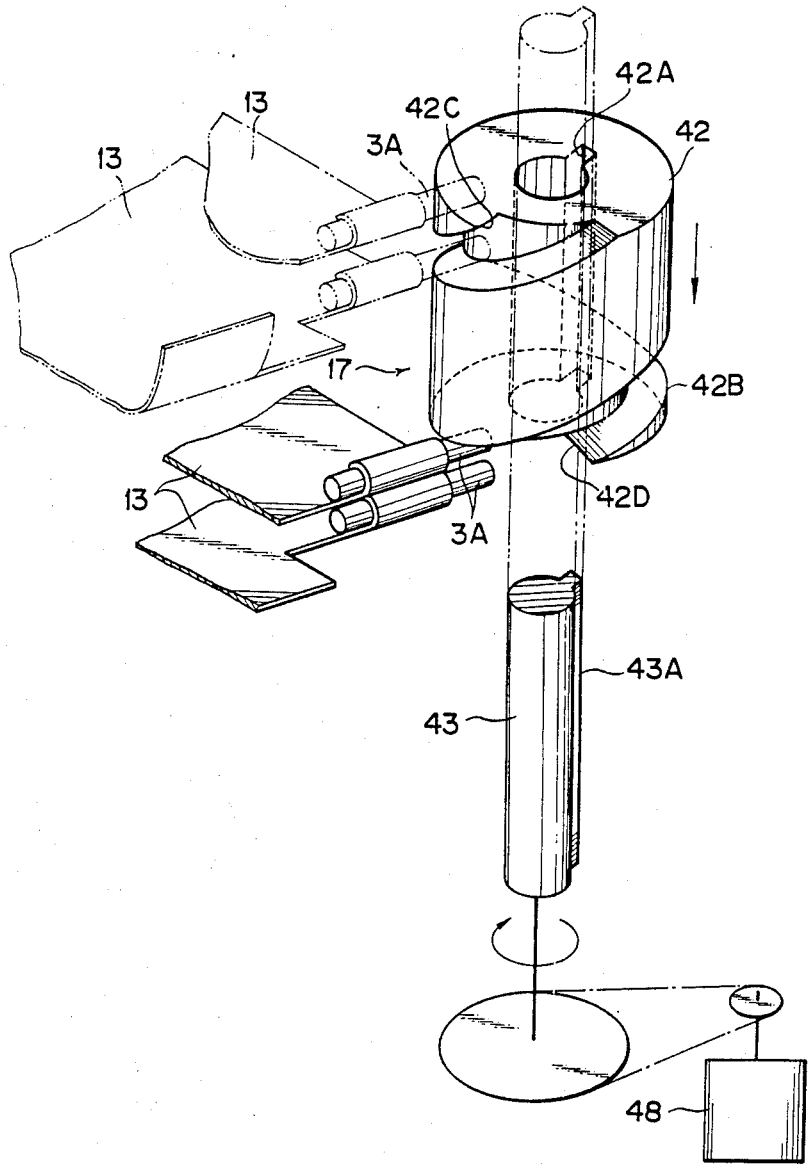
FIG. 5 is a perspective view used to explain the mode of operation of a tray inlet holding member thereof.

As best shown in FIG. 5, the tray inlet holding member 42 is so engaged with the rotating shaft 43 that the holding member 42 is slidable only in a vertical direction. An axially extended guide ridge 43A of the rotating shaft 43 is engaged with an axial groove 42A of the tray inlet holding member 42, so that when and only when the rotating shaft 43 rotates, the tray inlet holding member 42 is caused to rotate in unison with the rotating shaft 43 while the tray inlet holding member 42 is kept slidable vertically by the rotating shaft 43.

A spiral groove 42B is cut into the cylindrical outer surface of the cylindrical tray inlet holding member 42 and its upper end 42C and lower end 42D are terminated into the shape of a wedge. In this embodiment, the spiral groove 42B has one lead between the upper and lower surfaces of the tray inlet holding member 42. Because of this spiral groove 42B, a pin 3A at the end on the inlet side of a tray 13 can be vertically moved.

Referring back to FIG. 4, reference numeral 25 designates a tray stand which supports the tray 13 at a predetermined inclined angle. The trays 13 are spaced apart from each other by a predetermined distance by the tray leading edges 3B and the pins 3A and are stacked on the tray stand 25. Reference numeral 48 designates a reversible motor for rotating the rotating shaft 43 in the clockwise or counterclockwise direction.

Next, the mode of operation of the sorting apparatus with the above-described construction will be described in detail hereinafter.

In FIG. 4, the tray inlet 17 is defined substantially in the middle of the stack of the trays 13. Under these conditions, the feeding passage 41 is maintained substantially horizontally.

Next, the mode of operation for forming the tray inlet 17 downwardly stage by stage from the position shown in FIG. 4 will be described with reference to FIG. 5. First, the motor 48 is so energized that the rotating shaft 43 is rotated in the clockwise direction. Then, the pin 3A of the tray 13 which is in contact with the lower surface of the tray inlet holding member 42 is led to the spiral groove 42B from the wedge-shaped lower end 42D thereof, so that as the rotating shaft 43 is rotated, the pin 3A is moved upwardly as shown. Therefore, when the rotating shaft 43 makes one rotation, the pin 3A is supported by the upper surface of the tray inlet holding member 42 and simultaneously the tray inlet holding member 42 is caused to move downward along the rotating shaft 43 by a distance equal to the diameter of the pin 3A. Therefore, the lower surface of the tray inlet holding member 42 is maintained to be in contact with the pin 3A which is positioned immediately below that pin 3A supported by the upper surface of the holding member 42, whereby a new tray inlet 17 is formed at a position one stage below.

So far the arrangement disposed on one side of the tray inlet 17 has been described with reference to FIGS. 4 and 5, but it is to be understood that the similar arrangement (not shown) is disposed at the other end of the tray inlet 17 and that its tray inlet holding member 42 and rotating shaft 43 are symmetrical with and have the similar shapes to those of the arrangement shown in FIG. 5. In either case, the pins 3A which engage with the spiral grooves 42B of the tray inlet holding members 42 are supported at the same level in an opposed relationship with each other.

It follows, therefore, that when the holding members 42 are formed symmetrically, the rotating shafts 43 are driven in synchronism with each other in the opposite directions. On the other hand, when the tray inlet holding members 42 have the same shape, the rotating shaft 43 are rotated in the same direction in synchronism with each other. In this embodiment, when the rotating shafts 43 are rotated in the clockwise direction, the tray inlet holding members 42 are lowered. As a result, the tray 13 which has been in contact with the lower surfaces of the holding members 42 are caused to move upward to the upper surfaces of the tray inlet holding members 42, so that the new tray inlet 17 is defined at a position one stage below.

Figure 6:
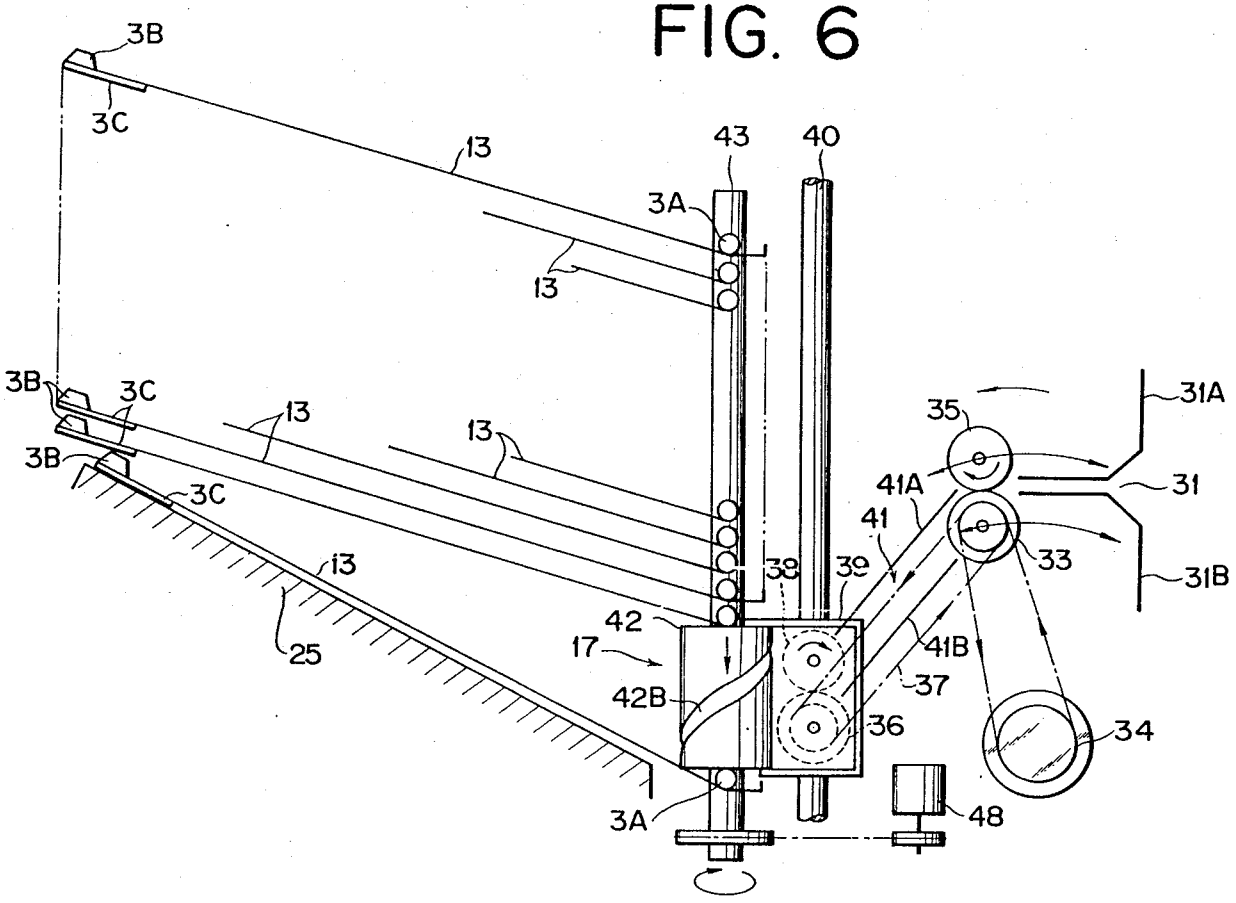
FIGS. 6 and 7 are schematic views showing the tray inlet holding member brought to its lowermost and uppermost positions, respectively.

The above-described steps are repeated so that the tray inlet 17 is sequentially moved downward. FIG. 6 shows that the tray inlet 17 is defined between the lowermost tray 13 and the second lowermost tray 13 immediately above it. Meanwhile, the pair of the feed roller 33 and the guide roller 35 are so designed and constructed that they can rotate around the shaft of the motor 34, so that their positions change as the frame 39 moves in accordance with the movement of the guide plates 41A and 41B.

Figure 7:
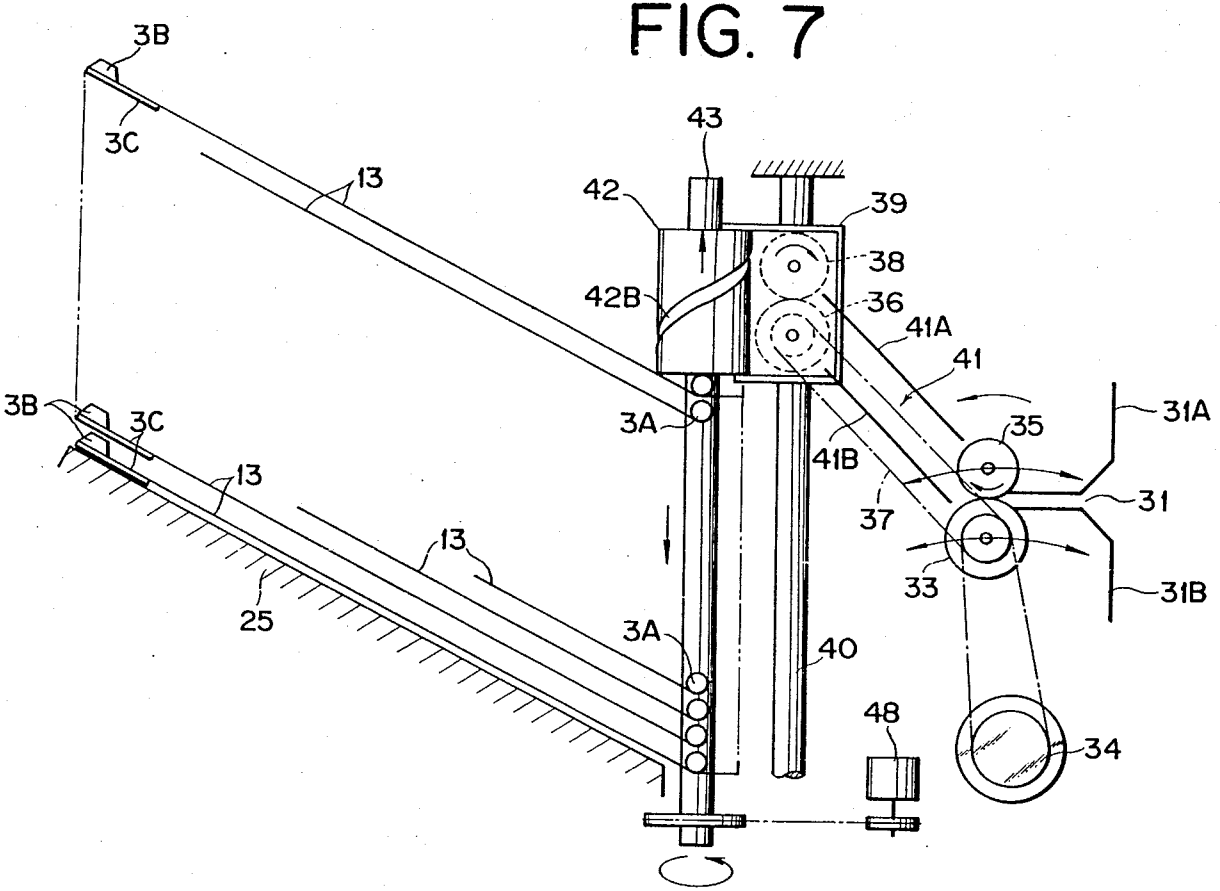

If the tray inlet 17 is sequentially shifted upward from the position shown in FIG. 6, the tray inlet 17 is finally formed as shown in FIG. 7, where the printed sheet 32 is fed onto the uppermost tray 13 as shown in FIG. 7.

Figure 8:
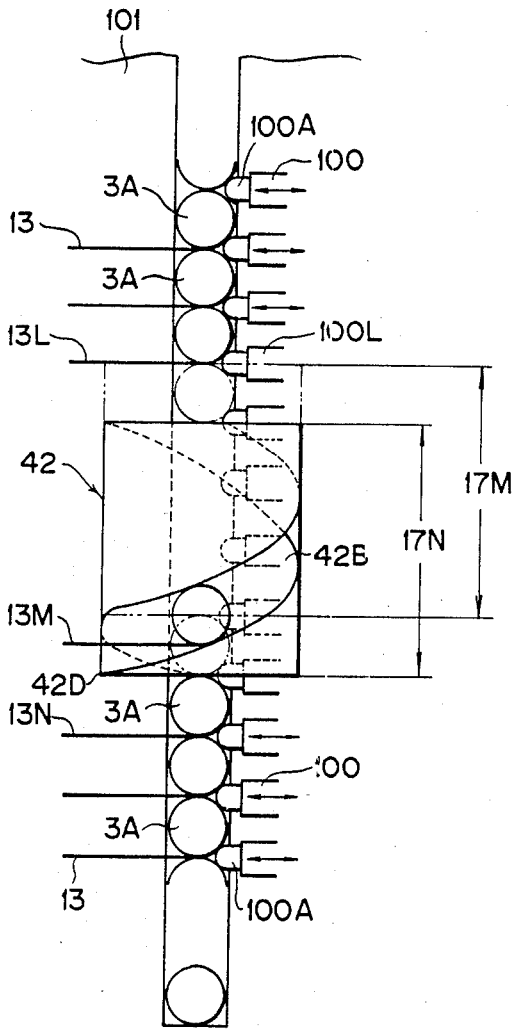
FIG. 8 is a schematic view showing the positions of pin supporting members and the operation of the tray inlet holding member in the embodiment of a sorting apparatus in accordance with the present invention.

In the sorting apparatus described above with reference to FIGS. 4–7, a pin supporting member 100 is interposed between the adjacent tray pins 3A as shown in FIG. 8 in such a way that each pair of pin supporting members 100 support the pins 3A extended from the both ends of the tray 13 on the inlet side, whereby the weight of the tray 13 can be shared by the pin supporting members 100.

Figure 9:
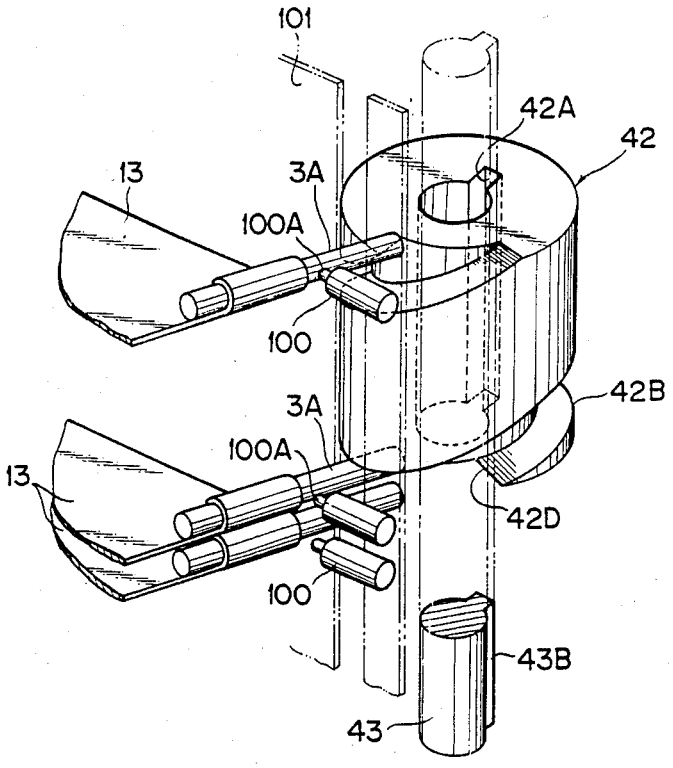
FIG. 9 is a perspective view showing an arrangement of the pin supporting member.

To this end, these pin supporting members 100 are disposed continuously or intermittently in a manner that the distance between the adjacent pin supporting members 100 is kept equal to the distance between the centers of the adjacent tray pins 3A in a condition that the trays 13 are stacked. As a result, as shown in FIG. 9, the pin supporting members 100 are securely fixed to a pin guide plate 101. In this embodiment, the pin supporting members 100 define a spring plunger. A center pin 100A protrudes from each of the pin supporting members 100 and makes contact with the lower surface of the tray pin 3A.

Each pin supporting member 100 accommodates a spring (not shown) which keeps the center pin 100A protruded from the member 100 as shown in FIG. 9. When the force acts on the center pin 100A in the direction perpendicular to the axis of the member 100, the component of this force withdraws the center pin 100A into the member 100 against the spring force. Therefore, in this embodiment, the force of the spring of the member 100 is so selected that when the tray pin 3A is displaced by the tray inlet holding member 42, the pin 3A pushes the center pin 100A downward and gets over the pin 100A.

As to the selection of the force of the spring in the member 100, it is preferable that the safety factor is taken into consideration and the spring force is a few times greater than the weight of the tray 3 shared at the position that the tray 3 is supported in order to support the tray 3 when the tray 3 is completely filled with the printed sheets.

Next, the movement of the tray 13 by the tray inlet holding member 42 in the sorting apparatus with the above-described construction will be described. FIG. 8 shows the condition that the tray 13 is moving. Prior to the movement, it is assumed that the tray inlet 17M is defined between the L-th (from the uppermost tray) 13L and the M-th tray 13M. When the tray 13M is moved upward, a new tray inlet 17N is defined at a position below by one stage, as shown in FIG. 8.

More specifically, the tray 13M is fitted into the spiral groove 42B of the holding member 42, so that the holding member 42 is lowered to the position of the pin 3A of the tray 13N which is disposed immediately below the tray 13M. On the other hand, the tray 13L is supported by the L-th pin supporting member 100L. As a result, the trays 13 above the tray 13L are individually supported by the respectively corresponding pin supporting members 100, so that when the tray 13M is moved upward and made into contact with the tray 13L, the inlet holding member 42 bears only the shared weight of the tray 13L.

When the tray 13M is moved upward, it suffices to get over the pin supporting members 100 in the upward path against the spring force. During this movement, the work done by the inlet holding member 42 consists only of the work required for lifting only one tray 13M against its friction and the work required for getting over the pin supporting member 100. Therefore, it is not necessary to rotate the inlet holding member 42 against the shared weight of the whole trays above the tray 13L, so that the force required for driving the inlet holding member 42 can be remarkably decreased.

As the tray 13 is in the lower position, as shown in FIG. 4, the tray leading edges 3B are stacked, so that the holding force of the pin supporting member 100 must be increased to some extent. But, as the safety factor is taken into consideration as described above, the holding force will not exceed the supporting force.

On the other hand, in case that it is desired to move the tray 13 upward beyond the holding member 42 when the inlet holding member 12 is at its uppermost position as shown in FIG. 7, it is not sufficient that the tray pin 3A is forced into the spiral groove 42B by moving the inlet holding member 42 downward by its own weight.

Figure 10:
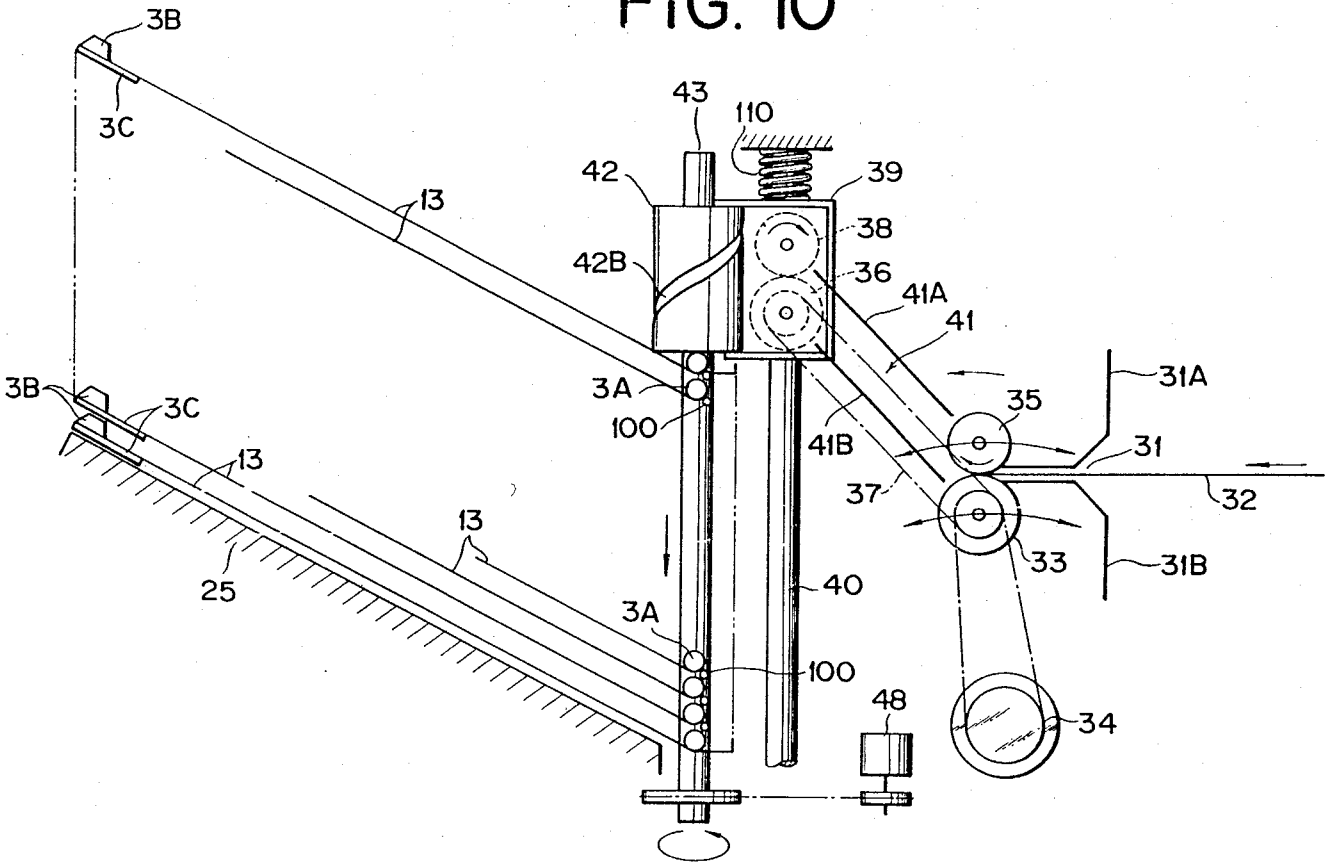
FIG. 10 is a schematic views showing an arrangement of the tray inlet holding member of the sorting apparatus in accordance with the present invention.

In view of the above, an embodiment shown in FIG. 10 has a coiled spring 110 which is provided along the guide rod 40 above the supporting frame 39. Under the above-described condition where the holding member 42 is positioned at its uppermost position, as shown in FIG. 10, the spring 110 remains compressed.

Therefore, the holding member 42 can be pressed against the tray pin 3A at the uppermost position by the force of the coiled spring 110 through the frame 39, so that the pin 3A is pushed to be introduced into the guide spiral groove 42B. Thus, the holding member 42 can be lowered effectively.

So far the mode of operation for shifting the tray inlet 17 downward has been described and it is apparent that when the tray inlet 17 is shifted upward, the same advantageous effects can be attained by the pin supporting members 100.

Figure 1:
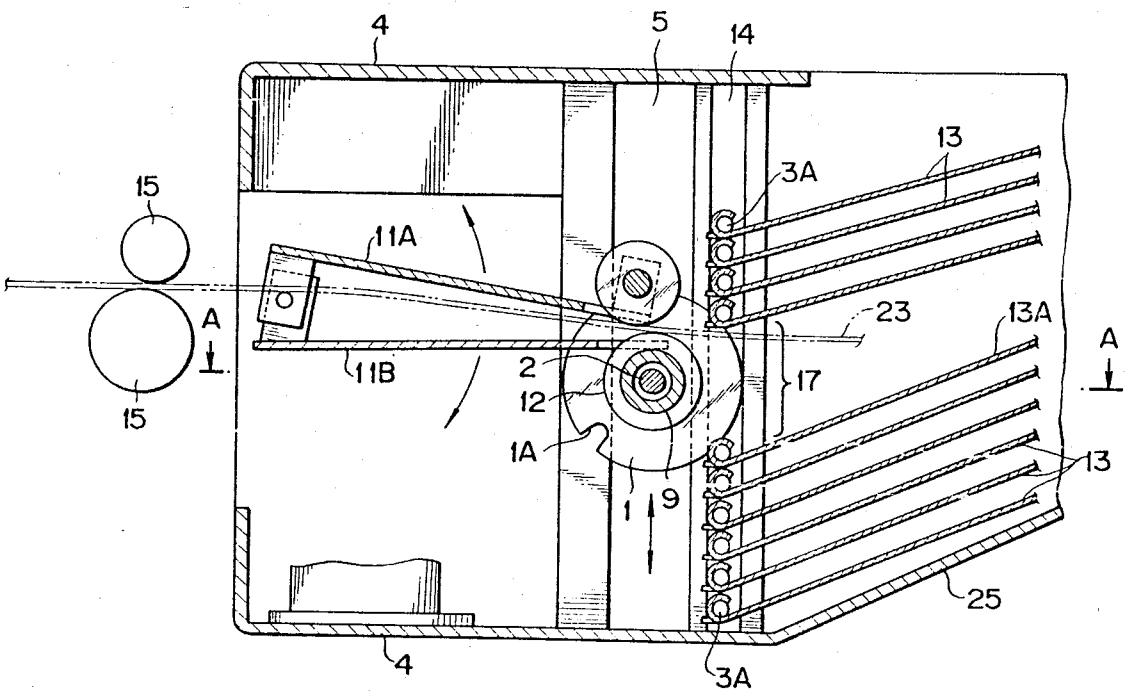
FIG. 1 PRIOR ART
FIG. 1 is a schematic view showing an example of a prior art sorting apparatus.
Figure 2:
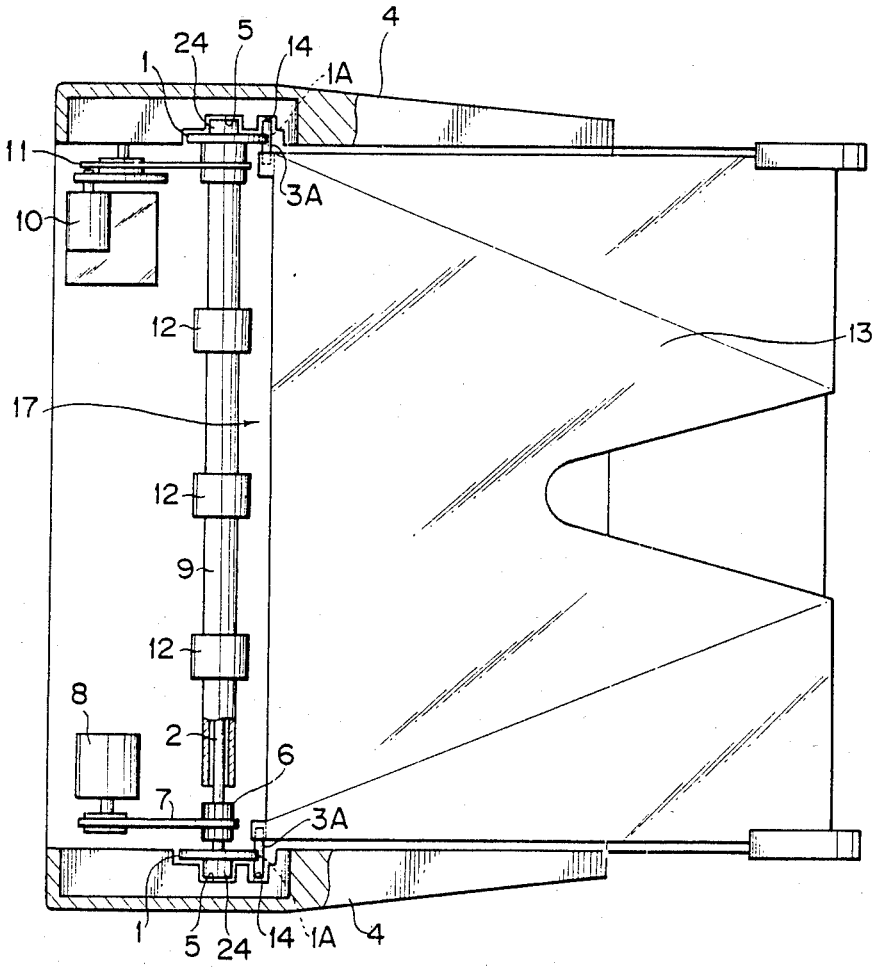
FIG. 2 PRIOR ART
FIG. 2 is a plan view of a tray inlet holding member of the sorting apparatus shown in FIG. 1, viewed from A—A plane.
Figure 3:
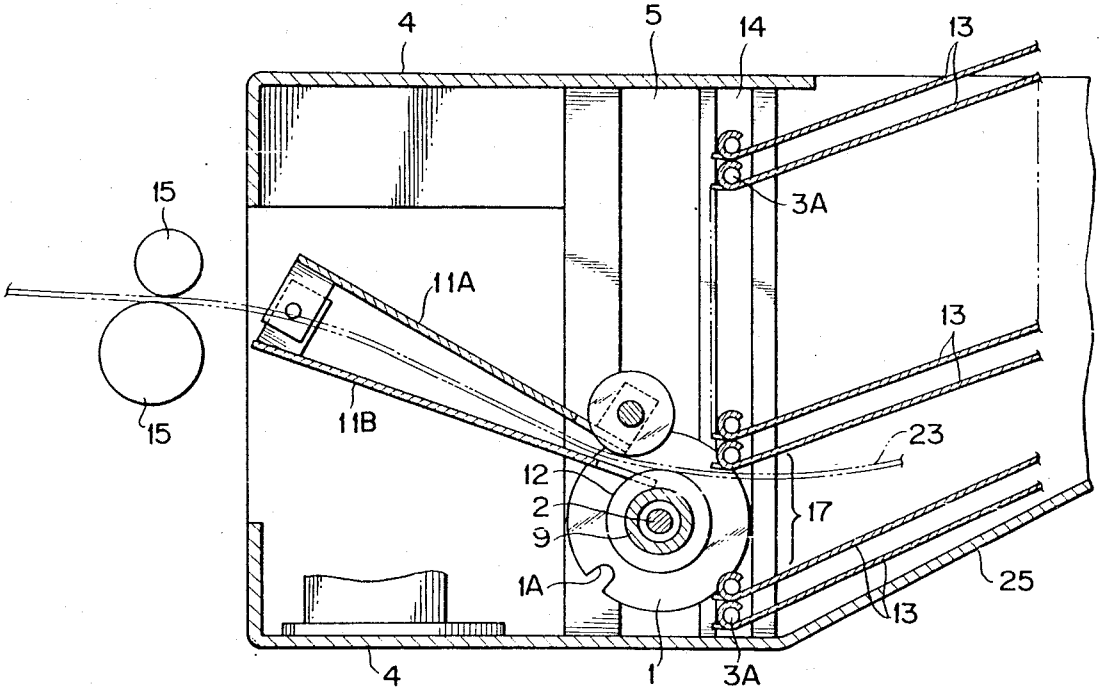
FIG. 3 PRIOR ART
FIG. 3 is a schematic view showing the tray inlet holding member brought to the second lowest position thereof in the sorting apparatus shown in FIG. 1.
Figure 11:
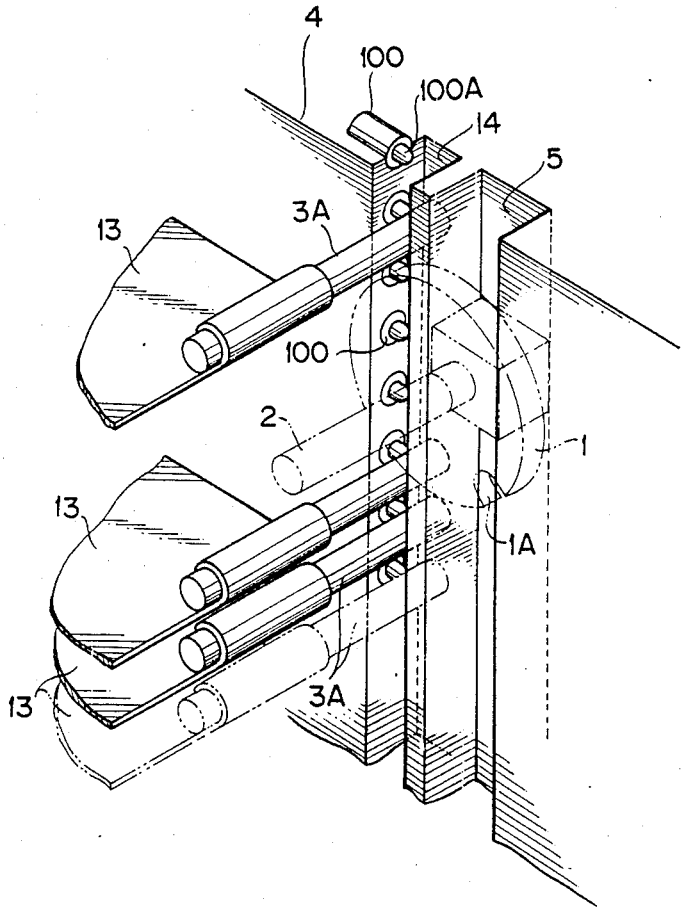
FIG. 11 is a perspective view showing the arrangement of pin supporting members in another embodiment of the present invention.

Next, referring to FIG. 11, a further embodiment in which the pin supporting members 100 are applied to the sorting apparatus of the type shown in FIGS. 1–3. In this embodiment, the pin supporting members 100 are embedded into the wall of the guide groove 5 of the frame wall 4. The pin 3A of each tray 13 is supported by the pin supporting member 100. When the tray 13 is moved vertically by the Geneva wheel 1, the supporting pin 3A moves up or down to a predetermined position while getting over the ends of the supporting members 100.

While in the above embodiments, the spring plunger is used as the pin supporting member 100, it is to be understood that the pin supporting member is not limited to the spring plunger and that a widely used member such as a spring-held roller or a leaf spring may be equally used which supports a load until the load exceeds a predetermined value and which is retracted when the load exceeds the predetermined value.

As described above, according to the present invention, there are provided a plurality of trays, each of which has a pair of tray pins on the side of its inlet and which is stacked upon a vertically adjacent tray, and the inlet holding members adapted to be interposed between the tray pins of the vertically adjacent trays to define a tray inlet. The inlet holding members are vertically movable and rotatable. Upon rotation of the inlet holding members, the tray pin in contact with the upper or lower surface of the holding member is moved upward or downward, while the holding member itself is moved in the opposite direction, so that the tray inlet is shifted. In addition, the supporting members which are made into contact with the tray pins, respectively, each of which is capable of bearing the shared load of each tray, and over which the tray pins get when the bearing load exceeds a predetermined value are disposed at the positions which will not interfere with the movement of the holding members. As a result, not only the defects encountered in the prior art sorting apparatus in which the tray inlet is fixed are overcome, but also each tray is supported by a pair of supporting members and when the tray inlet is defined successively, the holding members does not bear the whole weight of the trays stacked over the holding members. As a result, unlike the prior art sorting apparatus in which the holding members bear the whole weight of the plural trays, a great driving force for rotating the holding member is not required. Therefore, the capacity of the motor for driving the holding member can be decreased and the cost of the sorting apparatus itself can be reduced. Even when a new sorting apparatus is designed and constructed, the motor capacity can be determined easily based upon the weight of the tray itself.

What is claimed is:

1. A sorting apparatus comprising:

a plurality of trays, each tray having a pair of tray pins on the both sides of the sheet inlet of said tray and being held in a condition that said trays are stacked;

tray inlet holding members interposed between the tray pins of the vertically adjacent trays in a manner that said tray inlet holding members define an inlet for a sheet, said tray inlet holding members being vertically movable and rotatable;

member which, upon rotation of said tray inlet holding members, moves the tray pins which are in contact with said tray inlet holding members vertically while said tray inlet holding members move in the opposite vertical direction, thereby shifting the sheet inlet; and supporting members which are so disposed that said supporting members do not interfere with the vertical movement of said tray inlet holding members and that said supporting members make contact with a peripheral surface of the respective pairs of said tray pins in such a manner that said supporting members bear the bearing load produced from each tray and permit said tray pins to override said supporting members when said bearing load is greater than a predetermined value.

2. A sorting apparatus as claimed in claim 1, wherein said tray inlet holding members are a pair of cylinders, each of which has a spiral groove formed on the cylindrical surface thereof and which are slidably supported by a pair of rotating shafts arranged vertically in parallel, respectively, in a manner that said cylinders are rotated by said pair of rotating shaft, respectively.

3. A sorting apparatus as claimed in claim 1, wherein each of said tray inlet holding members has a geneva cam which is rotatable around a horizontal axis and which has a slot which is formed in the outer peripheral surface thereof and in which said tray pin is housed.

4. A sorting apparatus as claimed in claim 1 wherein the tray pins include an elastic member such that the supporting member make contact with a peripheral surface of the respective pair of tray pins by an elastic force and wherein the supporting members bear the bearing load produced from each tray and permit the tray pins to override the supporting members against the elastic force of the elastic member when said bearing load is greater than a predetermined value.

5. A sorting apparatus as claimed in claim 4, wherein said tray inlet holding members are a pair of cylinders, each of which has a spiral groove formed on the cylindrical surface thereof and which are slidably supported by a pair of rotating shafts arranged vertically in parallel, respectively, in a manner that said cylinders are rotated by said pair of rotating shafts, respectively.

6. A sorting apparatus as claimed in claim 4, wherein each of said tray inlet holding members has a geneva cam which is rotatable around a horizontal axis and which has a slot which is formed in the outer peripheral surface thereof and in which said tray pin is housed.

7. A sorting apparatus as claimed in claim 4 wherein the tray pins include an elastic member such that the supporting members make contact with a peripheral surface of the respective pair of tray pins by an elastic force and wherein the supporting members bear the bearing load produced from each tray and permit the tray pins to override the supporting members against the elastic force of the elastic member when said bearing load is greater than a predetermined value.

8. A sorting apparatus comprising:

a plurality of trays, disposed about a rotating shaft, each tray having a pair of tray pins for holding trays in a generally vertical stacked position;

tray inlet holding members interposed between the respective tray pins of the vertically adjacent trays, the tray inlet holding members defining an inlet for a sheet, the tray inlet holding members being vertically movable and rotatable;

means for moving the tray which are in contact with a tray inlet holding members while the tray inlet holding members move in an opposite vertical direction from the moving means, upon rotation of the tray inlet holding members, thereby shifting the sheet inlet; and supporting members disposed about the rotatable shaft for making contact with the peripheral surface of a respective pair of tray pins without interfering with the vettical movement of the tray inlet holding members, such that the supporting members bear the bearing load produced from each tray and permit the tray pins to override the supporting members when the bearing load is greater than a predetermined value.

* * * * *